US008078086B2

(12) United States Patent
Nishiyama et al.

(10) Patent No.: US 8,078,086 B2
(45) Date of Patent: Dec. 13, 2011

(54) LIQUID DEVELOPER TRANSPORT DEVICE AND IMAGE FORMING APPARATUS

(75) Inventors: Kazuhiro Nishiyama, Matsumoto (JP); Tsutomu Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 560 days.

(21) Appl. No.: 12/259,569

(22) Filed: Oct. 28, 2008

(65) Prior Publication Data

US 2009/0116876 A1 May 7, 2009

(30) Foreign Application Priority Data

Nov. 2, 2007 (JP) ..... 2007-285950
May 14, 2008 (JP) ..... 2008-127067

(51) Int. Cl.
*G03G 15/10* (2006.01)
*G03G 21/00* (2006.01)
*G03G 21/10* (2006.01)

(52) U.S. Cl. ..... 399/238; 396/565; 396/626; 399/249

(58) Field of Classification Search ..... 399/237, 399/238, 249, 250; 396/565, 626
See application file for complete search history.

(56) References Cited

U.S. PATENT DOCUMENTS

| | | | | |
|---|---|---|---|---|
| 4,994,860 | A * | 2/1991 | Lunde et al. | 399/238 |
| 5,933,689 | A * | 8/1999 | Kim | 399/233 |
| 5,950,054 | A * | 9/1999 | Kim | 399/237 |
| 6,011,943 | A * | 1/2000 | Kim | 399/238 |
| 6,238,109 | B1 * | 5/2001 | Minami | 396/604 |
| 6,442,363 | B2 * | 8/2002 | Chae et al. | 399/237 |
| 6,488,421 | B2 * | 12/2002 | Earle et al. | 396/565 |
| 6,508,597 | B2 * | 1/2003 | Pagano et al. | 396/565 |
| 7,630,671 | B2 * | 12/2009 | Aruga et al. | 399/237 |
| 2001/0031156 | A1 * | 10/2001 | Chae et al. | 399/237 |
| 2002/0114637 | A1 * | 8/2002 | Park et al. | 399/57 |
| 2007/0140739 | A1 * | 6/2007 | Aruga et al. | 399/249 |

FOREIGN PATENT DOCUMENTS

| | | | |
|---|---|---|---|
| JP | 08044217 | A * | 2/1996 |
| JP | 09311557 | A * | 12/1997 |
| JP | 2000-089578 | | 3/2000 |
| JP | 2001134101 | A * | 5/2001 |
| JP | 2002229340 | A * | 8/2002 |
| JP | 2002296913 | A * | 10/2002 |

* cited by examiner

*Primary Examiner* — David Gray
*Assistant Examiner* — Fred L Braun
(74) *Attorney, Agent, or Firm* — DLA Piper LLP (US)

(57) ABSTRACT

A liquid developer transport device includes a channel switching part that dispenses liquid developer to a first channel or a second channel. A filtering part filters liquid developer flowing in the first channel, and a first storage part stores the filter liquid developer. A second storage part stores liquid developer flowing in the second channel. The channel switching part switches channels when a toner particle concentration is more than a predetermined concentration.

15 Claims, 12 Drawing Sheets

LIQUID DEVELOPER TRANSPORT DEVICE AND IMAGE FORMING APPARATUS

BACKGROUND

1. Technical Field

The present invention relates to a liquid developer transport device that separates a liquid carrier from a liquid developer, and an image forming apparatus such as a facsimile, printer, and copier including the liquid developer transport device.

2. Related Art

A wet-process image forming apparatus using a high-viscosity liquid developer in which toner particles of solid components are dispersed in a liquid carrier to develop an electrostatic latent image for visualizing the electrostatic latent image has been proposed. The developer used in the wet-process image forming apparatus contains a liquid carrier of an electrically insulating organic solvent such as silicone oil, mineral oil, vegetable oil, and toner particles of solid components dispersed in the liquid carrier. The particle diameter of the toner particles is about 1 μm. On the other hand, the particle diameter of powder toner particles used in a dry-process image forming apparatus is about 7 μm. Accordingly, the image quality of an image formed by the wet-process image forming apparatus is higher than the image quality of an image formed by the dry-process image forming apparatus.

The liquid carrier of the developer used in the wet-process image forming apparatus prevents flying of the toner particles having a particle diameter of about 1 μm and facilitates the movement of the toner particles by the action of an electric field in the developing and transfer steps. Accordingly, the liquid carrier is a necessary component for preservation of the liquid developer, transportation of the liquid developer, the developing step, and the transfer step. However, the liquid carrier also attaches to non-image areas, and the excessive liquid carrier after development may cause disadvantageous phenomena for image formation such as transfer irregularities. On this account, the liquid carrier of the liquid developer on a photoconductor and a transfer member is removed (squeezed) and collected. Further, also the liquid developer remaining on the photoconductor and the transfer member after the transfer step is removed and collected.

For reuse of the collected liquid developer, an image forming apparatus of allowing the liquid developer removed and collected by cleaning means to pass through filtering means including a foam on which an electric field acts for separating and extracting the liquid carrier from the liquid developer has been considered (for example, see JP-A-2000-89578). FIG. 1 shows an embodiment of a monochrome image forming apparatus in the related art. A liquid developer stored within a liquid developer container 31 is fed to a stirring tank 53. When the toner particle concentration of the liquid developer stored within the liquid developer container 31 becomes low, the high-concentration liquid developer is fed from a supplementary liquid developer tank 54 to the stirring tank 53 by a pump 553, and further, a liquid carrier is fed from a liquid carrier tank 57 to the stirring tank 53 for adjustment of the toner particle concentration in the liquid image developer stored in the stirring tank 53 to a constant value. When the toner particle concentration of the liquid developer becomes high, the liquid carrier is fed from the liquid carrier tank 57 to the stirring tank 53. The liquid developer with adjusted constant toner particle concentration is fed to the liquid developer container 31 by a pump 551. The liquid developer collected by a photoconductor cleaning device including a cleaning blade 17 and a liquid developer collecting part 18 is stored in a photoconductor buffer tank 51, and then, fed to a filtering unit 56. The liquid developer collected by an intermediate transfer member cleaning device including a cleaning blade 46 and a liquid developer collecting part 47 is also fed to the filtering unit 56. The liquid carrier is separated from the liquid developer filtered in the filtering unit 56, and the liquid carrier is stored in the liquid carrier tank 57 and reused.

FIG. 2 shows an embodiment of a color image forming apparatus in the related art. Developers stored within liquid developer containers 31Y, M, C, K are fed to stirring tanks 53Y, 53M, 53C, 53K. When the toner particle concentrations of the liquid developers stored within the liquid developer containers 31Y, M, C, K become low, the high-concentration liquid developers are fed from supplementary liquid developer tanks 54Y, 54M, 54C, 54K to the stirring tanks 53Y, 53M, 53C, 53K by pumps 553Y, 553M, 553C, 553K, and further, a liquid carrier is fed from a liquid carrier tank 57 to the stirring tanks 53Y, 53M, 53C, 53K for adjustment of the toner particle concentrations in the liquid image developers stored in the stirring tanks 53Y, 53M, 53C, 53K to constant values. When the toner particle concentrations of the liquid developers become high, the liquid carrier is fed from the liquid carrier tank 57 to the stirring tanks 53Y, 53M, 53C, 53K. The liquid developers with adjusted constant toner particle concentrations are fed to the liquid developer containers 31Y, M, C, K by pumps 551Y, 551M, 551C, 551K. The liquid developers collected by photoconductor cleaning devices including cleaning blades 17Y, 17M, 17C, 17K and liquid developer collecting parts 18Y, 18M, 18C, 18K are stored in photoconductor buffer tanks 51Y, 51M, 51C, 51K, and then, fed to a filtering unit 56. The liquid developers collected by an intermediate transfer member cleaning device including a cleaning blade 46 and a liquid developer collecting part 47 are also fed to the filtering unit 56. The liquid carrier is separated from the liquid developers filtered in the filtering unit 56, and the liquid carrier is stored in the liquid carrier tank 57 and reused.

The image forming apparatuses in the related art have disadvantages that the solid components in the collected liquid developer remain in the foam incorporated in the filtering means and the performance of the filtering means quickly becomes lower.

SUMMARY

An advantage of some aspects of the invention is to provide a liquid developer transport device by which a liquid carrier is separated by a filtering part from a liquid developer and reused and the filtering performance of the filtering part is maintained for a long period, and an image forming apparatus including the liquid developer transport device.

A first aspect of the invention is a liquid developer transport device including: a channel switching part that dispenses a liquid developer; a first channel for flowing the liquid developer dispensed by the channel switching part; a filtering part provided in the first channel for filtering the liquid developer flowing in the first channel; a first storage part connected to the first channel for storing the liquid developer filtered by the filtering part; a second channel for flowing the liquid developer dispensed by the channel switching part; and a second storage part connected to the second channel for storing the liquid developer flowing in the second channel. The liquid developer transport device can separate a liquid carrier from the liquid developer and reuse it. Further, the liquid developer transport device does not allow the liquid developer at a high toner particle concentration to flow into the filtering part in the first channel but can discard it into the second storage part in the second channel, and thereby, the filtering part is hard to be clogged for a long period.

The liquid developer transport device can execute the step of dispensing the liquid developer to the first channel or the second channel, the step of filtering the liquid developer dispensed to the first channel, separating it into the concentrated liquid developer and the liquid carrier and storing the liquid carrier in the first storage part, and the step of storing the liquid developer dispensed to the second channel in the second storage part.

The filtering part may be across-flow filter. Since the cross-flow filter is hard to be clogged, the liquid developer transport device using the cross-flow filter for the filtering part can be operated in a long period without replacement of a filter in the filtering part.

The liquid developer transport device may have a liquid carrier transport part that transports the liquid developer filtered by the filtering part from the first storage part to the filtering part. The liquid developer transport device having a liquid carrier transport part that transports the liquid developer filtered by the filtering part from the first storage part to the filtering part can clean the filtering part using the liquid carrier separated from the liquid developer. Cleaning of the filtering part can extend the life of the filter of the filtering part.

The channel switching part may be a three-way valve. The liquid developer transport device using a three-way valve for the channel switching part can easily switch dispensation of the liquid developer to the first channel or the second channel by switching the three-way valve.

The channel switching part may include two pumps. The liquid developer transport device with the channel switching part including two pumps can easily switch dispensation of the liquid developer to the first channel or the second channel by turning ON/OFF of the two pumps.

A second aspect of the invention is an image forming apparatus including: an image carrier that carries a toner image; a cleaning part that collects a liquid developer on the image carrier; a channel switching part that dispenses the liquid developer collected by the cleaning part; a first channel for flowing the liquid developer dispensed by the channel switching part; a filtering part provided in the first channel for filtering the liquid developer flowing in the first channel; a first storage part connected to the first channel for storing the liquid developer filtered by the filtering part; a second channel for flowing the liquid developer dispensed by the channel switching part; and a second storage part connected to the second channel for storing the liquid developer flowing in the second channel.

The image forming apparatus can execute the step of forming a toner image on the image carrier, the step of collecting the liquid developer on the image carrier, the step of dispensing the collected liquid developer to the first channel or the second channel, the step of filtering the liquid developer dispensed to the first channel, separating it into the concentrated liquid developer and the liquid carrier, and storing the liquid carrier in the first storage part, and the step of storing the liquid developer dispensed to the second channel in the second storage part.

A third aspect of the invention is an image forming apparatus including: an image carrier that carries a toner image; a transfer member on which the toner image on the image carrier is transferred; a cleaning part that collects a liquid developer on the transfer member; a channel switching part that dispenses the liquid developer collected by the cleaning part; a first channel for flowing the liquid developer dispensed by the channel switching part; a filtering part provided in the first channel for filtering the liquid developer flowing in the first channel; a first storage part connected to the first channel for storing the liquid developer filtered by the filtering part; a second channel for flowing the liquid developer dispensed by the channel switching part; and a second storage part connected to the second channel for storing the liquid developer flowing in the second channel.

The image forming apparatus can execute the step of forming a toner image on the image carrier, the step of transferring the toner image on the image carrier to the transfer member, the step of collecting the liquid developer on the transfer member, the step of dispensing the collected liquid developer to the first channel or the second channel, the step of filtering the liquid developer dispensed to the first channel, separating it into the concentrated liquid developer and the liquid carrier, and storing the liquid carrier in the first storage part, and the step of storing the liquid developer dispensed to the second channel in the second storage part.

The image forming apparatus according to the second and third aspects can separate a liquid carrier from the liquid developer and reuse it. Further, the image forming apparatus does not allow the liquid developer at the high toner particle concentration to flow into the filtering part provided in the first channel but can discard it into the second storage part provided in the second channel, and thereby, the filtering part is hard to be clogged for a long period.

The filtering part may be across-flow filter. Since the cross-flow filter is hard to be clogged, the image forming apparatus using the cross-flow filter for the filtering part can be operated in a long period without replacement of a filter in the filtering part.

The image forming apparatus may have a liquid carrier transport part that transports the liquid developer filtered by the filtering part from the first storage part to the filtering part. The image forming apparatus having a liquid carrier transport part that transports the liquid developer filtered by the filtering part from the first storage part to the filtering part can clean the filtering part using the liquid carrier separated from the liquid developer. Cleaning of the filtering part can extend the life of the filter of the filtering unit.

The channel switching part of the image forming apparatus may be a three-way valve. The image forming apparatus using a three-way valve for the channel switching part can easily switch dispensation of the liquid developer to the first channel or the second channel by switching the three-way valve.

The channel switching part of the image forming apparatus may include two pumps. The image forming apparatus with the channel switching part including two pumps can easily switch dispensation of the liquid developer to the first channel or the second channel by turning ON/OFF of the two pumps.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
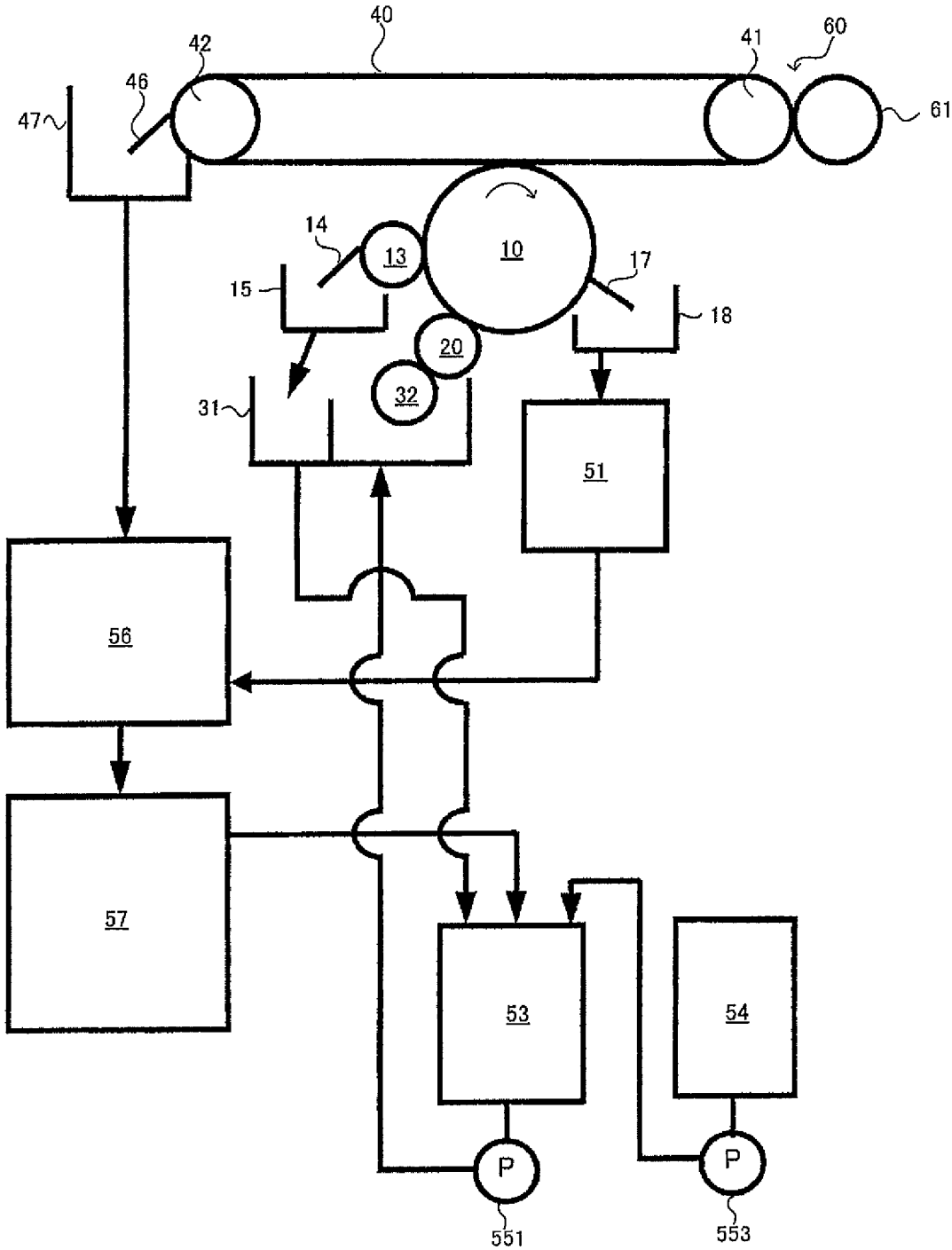
FIG. 1 is a schematic diagram showing an embodiment of a monochrome image forming apparatus in the related art.
Figure 2:
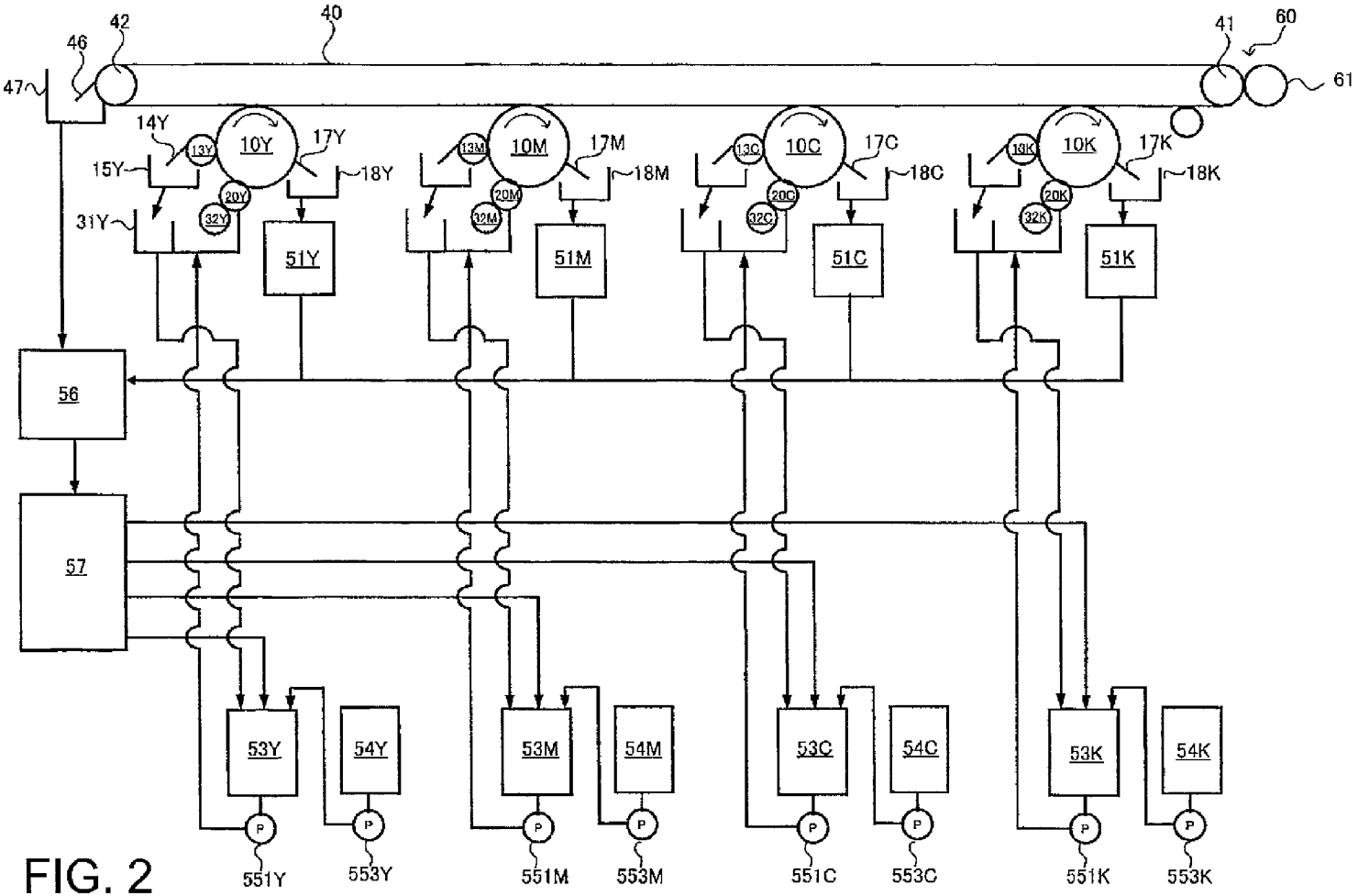
FIG. 2 is a schematic diagram showing an embodiment of a color image forming apparatus in the related art.
Figure 3:
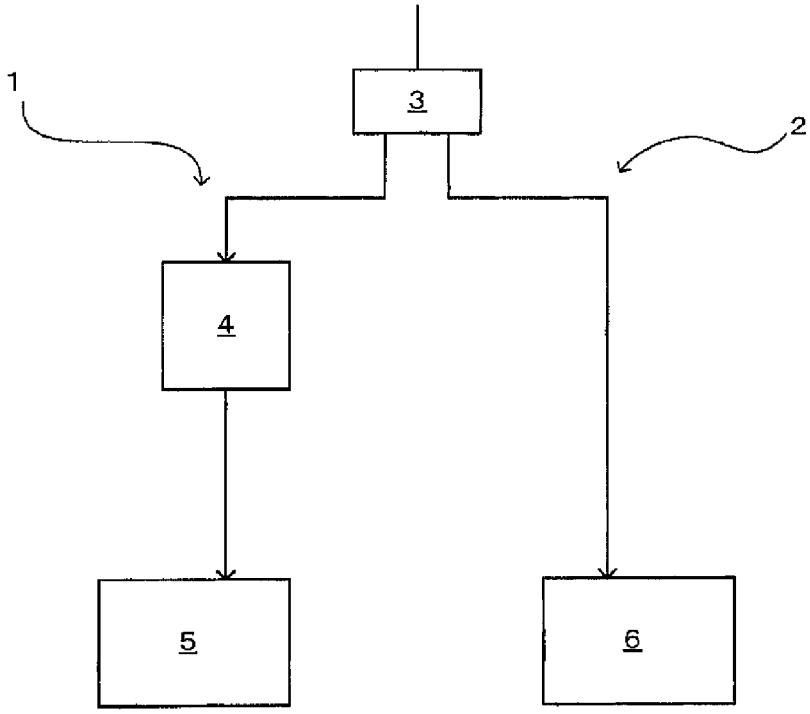
FIG. 3 is a schematic diagram of an embodiment of a liquid developer transport device.

Hereinafter, embodiments of the invention will be described with reference to the drawings. FIG. 3 is a schematic diagram of a liquid developer transport device of an embodiment of the invention. The liquid developer transport device of the embodiment has a channel switching part 3 that dispenses a liquid developer to a first channel 1 or a second channel 2. The first channel 1 has a filtering part 4 that filters the dispensed liquid developer and separates the developer into a concentrated liquid developer and a liquid carrier. A first storage part 5 that stores the liquid carrier is connected to the first channel 1. A second storage part 6 that stores the dispensed liquid developer is connected to the second channel 2.

The liquid carrier stored in the first storage part 5 may be reused. When the concentration of toner particles contained in the liquid developer is high, the liquid developer may be allowed to flow into the second channel 2 by switching of the channel switching part 3 and stored in the second storage part 6. The liquid developer stored in the second storage part 6 may be discarded.

Figure 4:
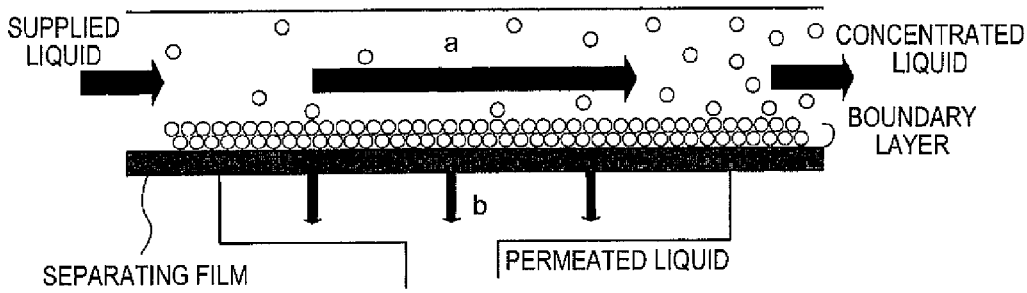
FIG. 4 is a schematic view of cross-flow filtration.

The filtering part 4 may be across-flow filter. FIG. 4 is a schematic view of cross-flow filtration. A separating film is provided in parallel to a liquid flow (arrow a) containing solid particles, and the permeated liquid permeated through the separating film flows in an orthogonal direction (arrow b) to the liquid flow. A boundary layer of solid particles is formed on the separating film and the solid particles that have not accumulated in the boundary layer flow out together with the liquid, and accordingly, the solid particle concentration in the liquid that has passed through the cross-flow filtration becomes higher and the liquid containing the solid particles is concentrated by the cross-flow filtration. The cross-flow filtration is hard to cause clogging and replacement of the separating film is unnecessary for a long period in cross-flow filtration. Therefore, the liquid developer transport device including the cross-flow filter can be operated for a long period without replacement of the filter at the filter part.

Figure 5:
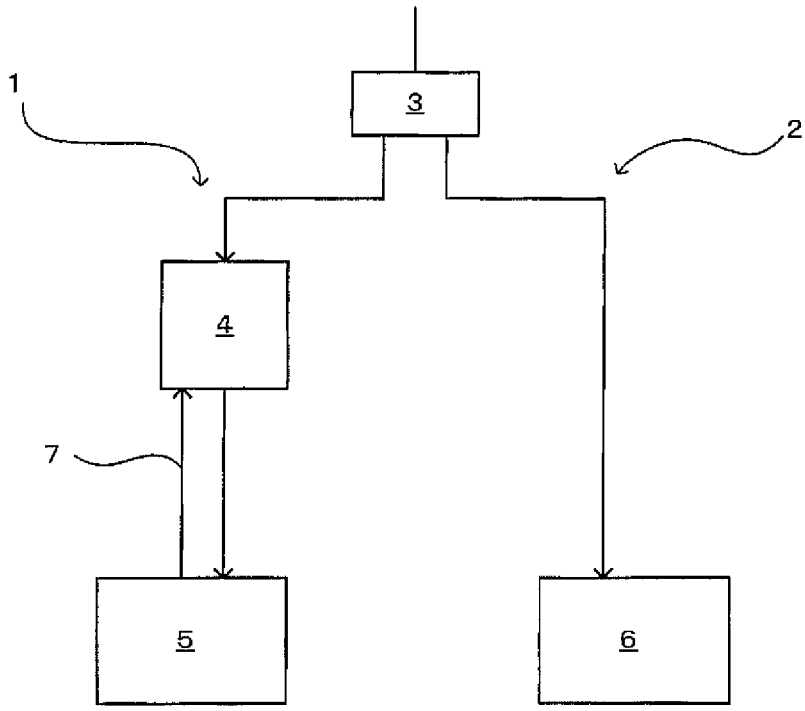
FIG. 5 is a schematic diagram showing an embodiment of a liquid developer transport device including a liquid carrier transport part.

The above described liquid developer transport device may have a liquid carrier transport part 7 that transports the liquid developer filtered in the filtering part 4 from the first storage part 5 to the filtering part 4. FIG. 5 is a schematic diagram showing an embodiment of a liquid developer transport device including the liquid carrier transport part 7. The liquid carrier stored in the first storage part 5 may be fed to the filtering part 4 through the liquid carrier transport part 7 that transports the liquid carrier from the first storage part 5 to the filtering part 4, and the filtering member of the filtering part 4 may be cleaned.

Figure 6:
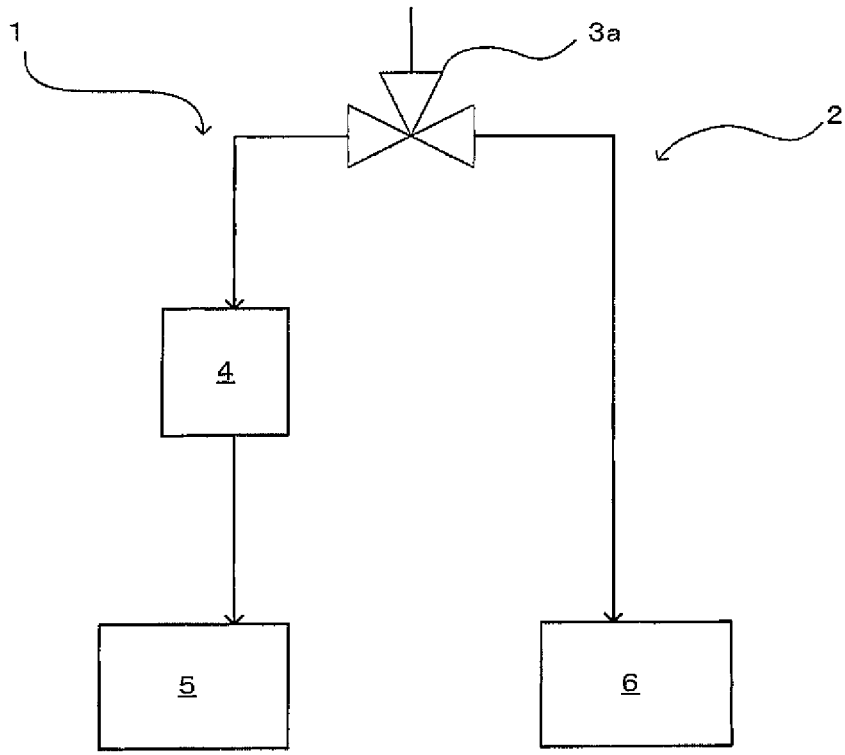
FIG. 6 is a schematic diagram showing an embodiment of a liquid developer transport device having a three-way valve.

The channel switching part 3 may be a three-way valve. FIG. 6 is a schematic diagram showing an embodiment of a liquid developer transport device having a three-way valve 3*a* as the channel switching part 3. By switching the three-way valve 3*a*, dispensation of the liquid developer to the first channel 1 or the second channel 2 can be easily switched.

Figure 7:
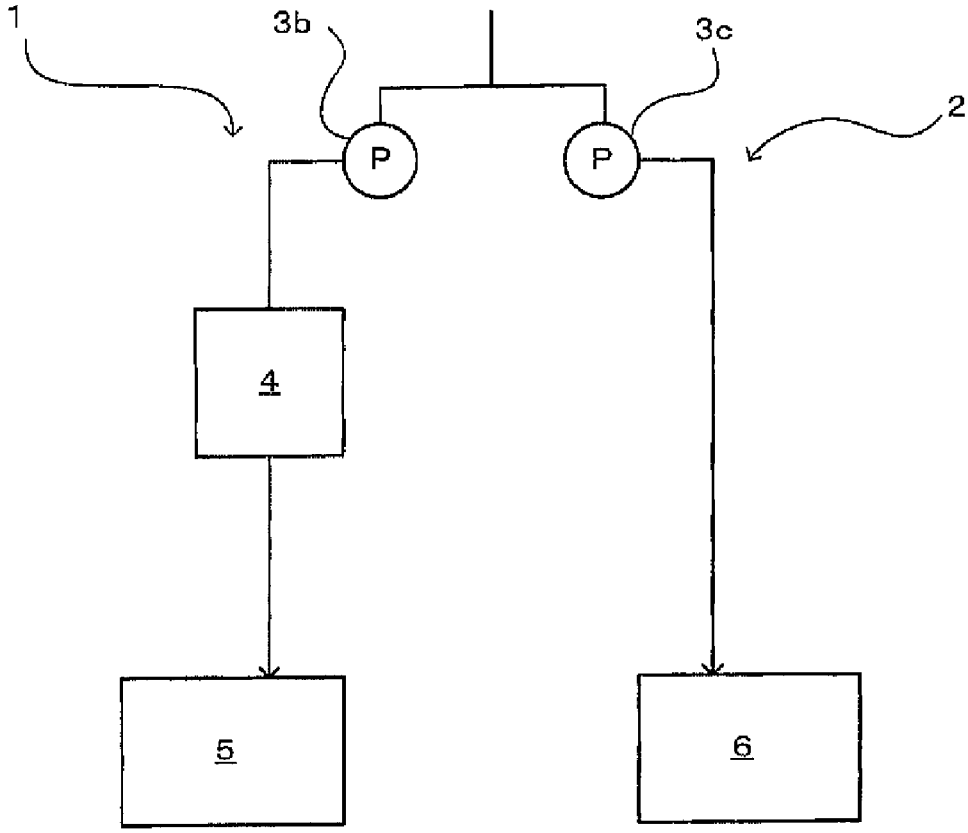
FIG. 7 is a schematic diagram showing an embodiment of a liquid developer transport device including two pumps.

The channel switching part 3 may include two pumps. FIG. 7 is a schematic diagram showing an embodiment of a liquid developer transport device with the channel switching part 3 including two pumps 3*b*, 3*c*. One of the two pumps 3*b*, 3*c* is activated and the other one is stopped. When the pump 3*b* connected to the first channel 1 is activated and the pump 3*c* connected to the second channel 2 is stopped, the liquid developer is dispensed to the first channel 1. When the pump 3*b* connected to the first channel 1 is stopped and the pump 3*c* connected to the second channel 2 is activated, the liquid developer is dispensed to the second channel 2. Therefore, the liquid developer transport device with the channel switching part 3 including the two pumps 3*b*, 3*c* can easily switch dispensation of the liquid developer to the first channel 1 or the second channel 2 by turning ON/OFF of the two pumps 3*b*, 3*c*.

Figure 8:
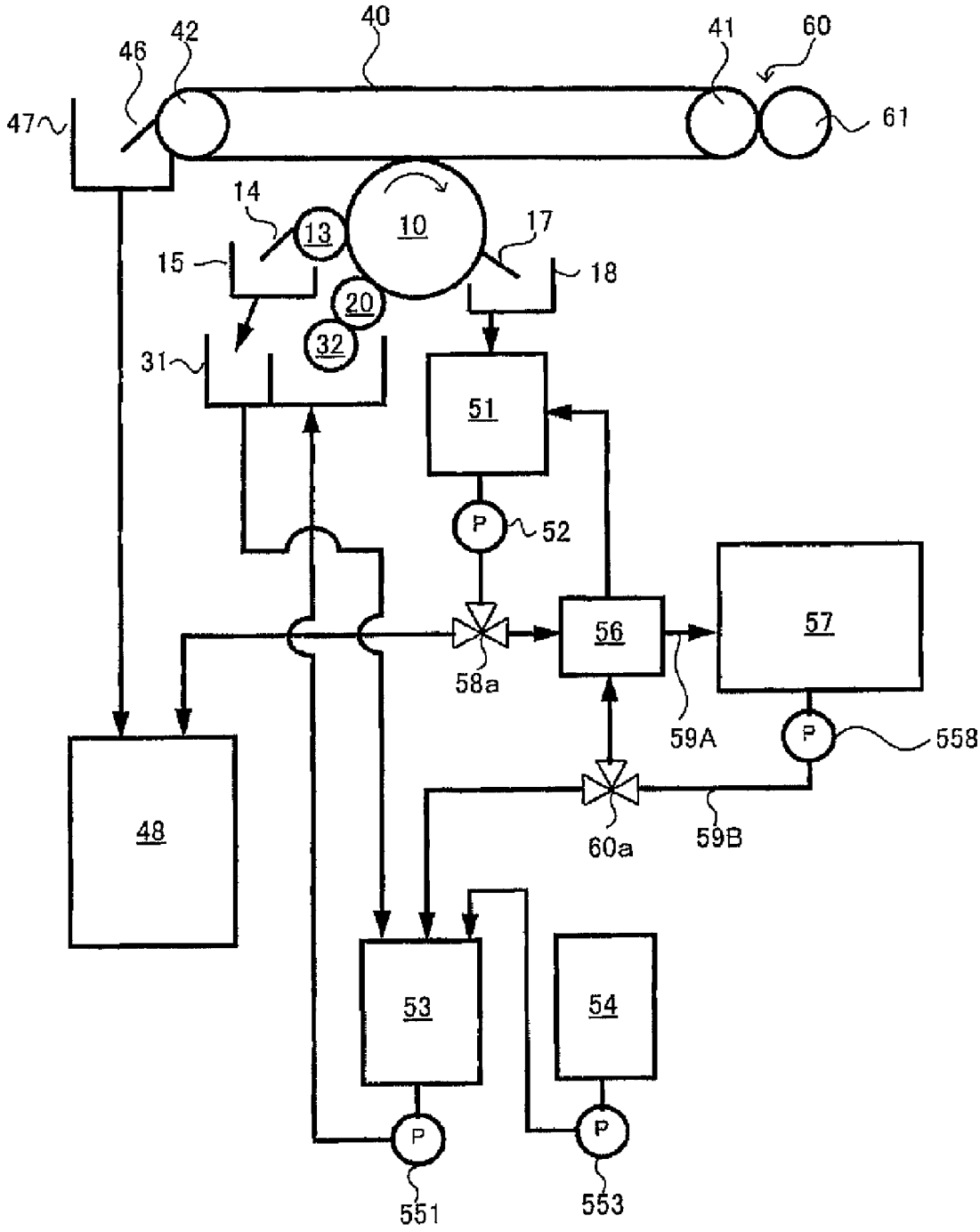
FIG. 8 is a schematic diagram showing an embodiment of a monochrome image forming apparatus.

FIG. 8 is a schematic diagram showing an image forming apparatus of an embodiment of the invention. An image forming part of the monochrome image forming apparatus of the embodiment includes, along a circumference in a rotational direction (moving direction) of a photoconductor 10 as an image carrier that carries toner images, a latent image eraser (not shown), a cleaning device as a cleaning part having a cleaning blade 17 and a developer collecting part 18 of the photoconductor 10 for collecting the liquid developer on the image carrier, a charging roller (not shown), an exposure unit (not shown), a developing roller 20 of a developing unit, and a cleaning device having a photoconductor squeeze roller 13 and a cleaning blade 14 as its auxiliary component, and a developer collecting part 15. The developing unit includes a cleaning blade (not shown), a developer supply roller 32 using an anilox roller and a regulating blade (not shown) that regulates the amount of supply of the developer of the roller along the circumference of the developing roller 20. A developer stirring roller (not shown) that stirs the developer into a homogeneously dispersed condition is provided in a liquid developer container (reservoir) 31 holding the liquid developer. A primary transfer roller (not shown) of a primary transfer section is provided in a position facing the photoconductor 10 with an intermediate transfer member 40 as a transfer member on which the liquid developer on the image carrier is to be transferred in between. An intermediate transfer member squeeze device (not shown) is provided at the downstream along the intermediate transfer member 40 in the moving direction thereof.

The liquid developer held in the liquid developer container 31 has high concentration and high viscosity, and contains a solvent that is nonvolatile at the normal temperature as a liquid carrier. That is, the liquid developer in the embodiment is a high-viscosity (about 30 to 10000 mpa·s) liquid developer having a toner solid content concentration of 25% by mass formed by adding solid particles having an average particle diameter of 1 μm in which a colorant such as a pigment is dispersed in a thermoplastic resin into a liquid solvent such as an organic solvent, silicone oil, mineral oil, or edible oil with a dispersant. The image forming apparatus of the embodiment of the invention does not use a liquid developer having low concentration (toner solid content concentration of about 1% to 2% by mass) and low viscosity and being volatile at the normal temperature containing Isopar (Trademark: EXSON), which is generally used in the related arts, as a liquid carrier.

In the image forming part and the developing unit, the charging roller (not shown) uniformly charges the photoconductor 10. A laser beam modulated according to an input image signal is applied from the exposure unit (not shown) having an optical system including a semiconductor laser, a polygon mirror, an F-θ lens, etc., and an electrostatic latent image is formed on the charged photoconductor 10. Then, the developer supply roller 32 supplies the liquid developer from the developer container 31 storing the liquid developer to the developing roller 20 and the electrostatic latent image formed on the photoconductor 10 is developed.

The intermediate transfer member 40 is an endless elastic belt member, hung around between a drive roller 41 and a tension roller 42 with tension, and rotationally driven by the drive roller 41 in contact with the photoconductor 10 at the primary transfer section. At the primary transfer section, the primary transfer roller (not shown) is provided to face the photoconductor 10 with the intermediate transfer member 40 in between. The developed toner image on the photo conductor 10 is transferred onto the intermediate transfer member 40 at the contact position of the photoconductor 10 and the intermediate transfer member 40 as a transfer position, and the toner image is formed. The toner image formed on the photoconductor 10 is primarily transferred onto the intermediate transfer member 40, and secondarily transferred onto a recording medium. The elastic belt member is adopted as the intermediate transfer member 40 so that, even when the recording medium surface is not smooth with fibers or the like, secondary transfer may follow the non-smooth recording medium surface.

In a secondary transfer section 60, a secondary transfer roller 61 is provided to face the belt drive roller 41 with the intermediate transfer member 40 in between, and a cleaning device including a cleaning blade (not shown) of the secondary transfer roller 61 and a developer collecting part (not shown) is further provided. In the secondary transfer section 60, the toner image formed on the intermediate transfer member 40 is secondarily transferred to a recording medium such as paper, film, and cloth to be transported and supplied from a recording medium transport path concurrently with the timing when the toner image reaches the transfer position of the secondary transfer section 60. At the upstream of the recording medium transport path, a fixing unit (not shown) is provided, and the monochrome toner image that has been secondarily transferred onto the recording medium is fixed to the recording medium by thermal fusion. The secondary transfer roller 61 is an elastic roller with a surface covered by an elastic material so that, even when the recording medium surface is not smooth with fibers or the like, secondary transfer may follow the non-smooth recording medium surface.

The cleaning device including a cleaning blade 46 and a liquid developer collecting part 47 for collecting the liquid developer of the intermediate transfer member 40 is provided at side of the tension roller 42 around which the intermediate transfer member 40 is hung with the belt drive roller 41. The intermediate transfer member 40 that has passed through the secondary transfer section 60 advances to the part in which the member is hung around the tension roller 42, the intermediate transfer member 40 is cleaned by the cleaning blade 46, and the intermediate transfer member 40 moves toward the primary transfer section again. The liquid developer collected by the liquid developer collecting part 47 is collected into a waste liquid tank 48 that stores the liquid developer as the second storage part.

The toner particles in the liquid developer have positive charge within the liquid developer container 31, and are stirred by the stirring roller (not shown) into a homogeneously dispersed condition. The liquid developer is drawn up from the liquid developer container 31 by the rotation of the developer supply roller 32, and supplied to the developing roller 20. Initially, the toner particles in the liquid developer stored within the liquid developer container 31 is homogeneously dispersed at a concentration of about 25% by mass. The amount of toner consumption is large at development with high coverage, and the amount of toner consumption is small at development with low coverage. That is, the toner particle concentration of the liquid developer stored within the liquid developer container 31 changes every second with the development to the photoconductor 10, and it is necessary to constantly monitor the change and substantially maintain the toner particle concentration to about 25% by mass.

For controlling the toner particle concentration in the liquid developer in the liquid developer container 31, a transmissive photosensor that senses the toner particle concentration, a torque sensing unit that senses stirring torque of the liquid developer stirring roller, and a unit that senses the toner particle concentration such as a reflective photosensor that senses the liquid level of the liquid developer within the liquid developer container 31 are provided in the developing unit. The liquid developer stored within the liquid developer container 31 is fed to the stirring tank 53. When the toner particle concentration of the liquid developer stored within the liquid developer container 31 becomes low, the high-concentration liquid developer at a toner particle concentration of about 35% to 55% by mass is fed from a supplementary liquid developer tank 54 to a stirring tank 53 by a pump 553, and further, the liquid carrier is fed from a liquid carrier tank 57 that stores the liquid carrier as the first storage part to the stirring tank 53 for adjustment of the toner particle concentration in the liquid image developer stored in the stirring tank 53 to about 25% by mass. When the toner particle concentration of the liquid developer stored in the liquid developer container 31 becomes high, the liquid carrier is fed from the liquid carrier tank 57 to the stirring tank 53 by a pump 558 sequentially through a second liquid carrier transport part 59B and a three-way valve 60*a*. The liquid developer with adjusted toner particle concentration of about 25% by mass is fed to the liquid developer container 31 by a pump 551.

The cleaning device as the cleaning part including the cleaning blade 17 and the liquid developer collecting part 18 for collecting the liquid developer on the photoconductor 10 is provided at the downstream side of the primary transfer part with respect to the rotational direction of the photoconductor 10. The liquid developer remaining on the photoconductor 10 after primary transfer is cleaned by the cleaning blade 17. The liquid developer cleaned by the cleaning blade 17 is collected by the liquid developer collecting part 18. The liquid developer collected by the liquid developer collecting part 18 is stored in a photoconductor buffer tank (PC buffer tank) 51 as a liquid developer buffer storage part. The liquid developer stored in the photoconductor buffer tank 51 is fed to a filtration filter 56 or the waste liquid tank 48 through a three-way valve 58*a* that dispenses the developer to the filtration filter 56 or the waste liquid tank 48 by a pump 52. The three-way valve 58*a* is a channel switching part that dispenses the liquid developer collected by the cleaning part for collecting the liquid developer on the image carrier. The filtration filter 56 is a filtering part provided in a first channel for flowing the liquid developer dispensed by the channel switching part for filtering the liquid developer flowing in the first channel. The liquid carrier tank 57 is a first storage part connected to the first channel for storing the liquid developer flowing in the first channel. The waste liquid tank 48 is a second storage part connected to a second channel for flowing the liquid developer dispensed by the channel switching part for storing the liquid developer flowing in the second channel.

Figure 9:
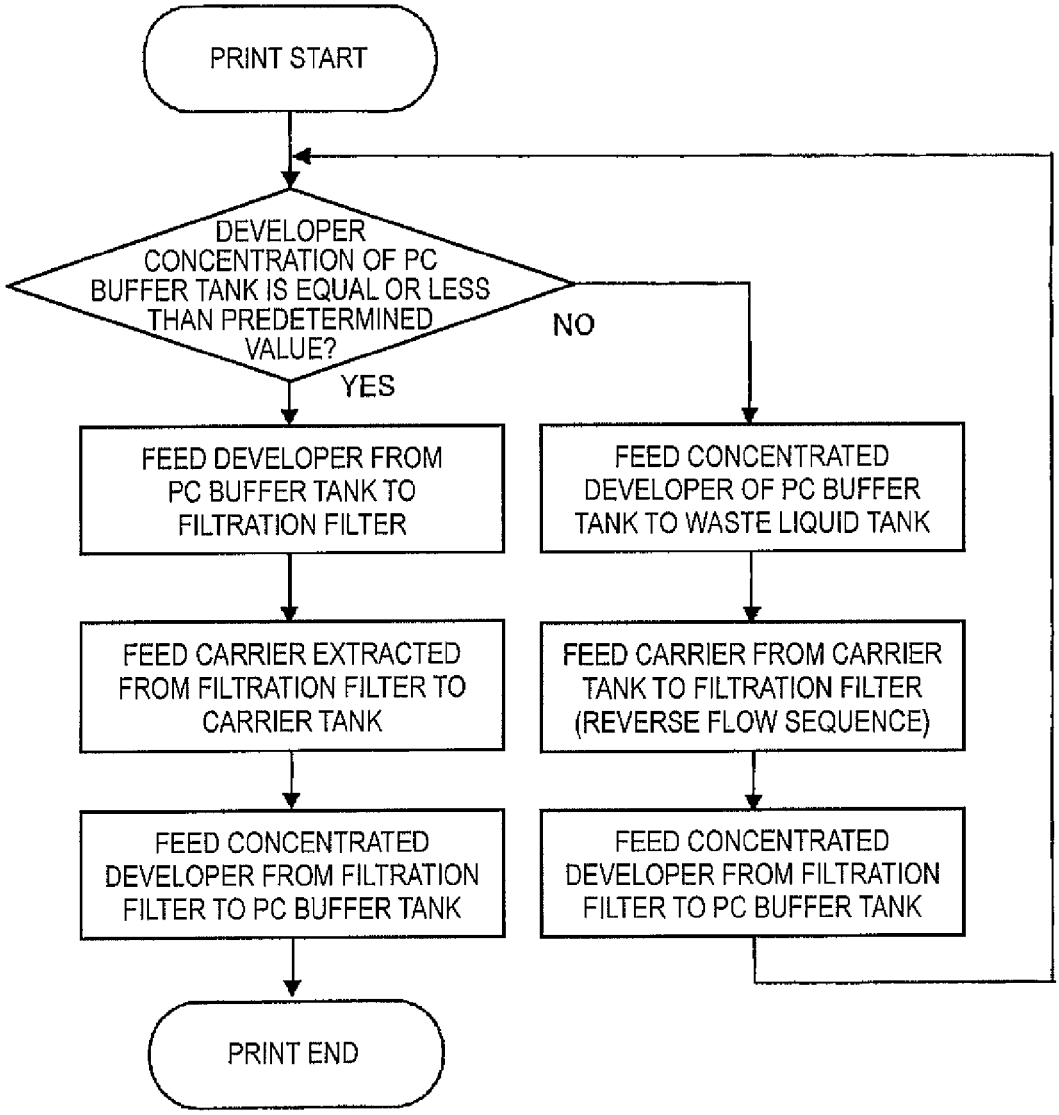
FIG. 9 is a flowchart of image formation by the monochrome image forming apparatus.

Specific examples of signals used for switching of the three-way valve 58*a* are signals of the concentration of toner particles contained in the liquid developer within the photoconductor buffer tank 51 (developer concentration), the pressure of the liquid developer fed from the three-way valve 58*a* to the filtration filter 56, the number of printed recording media, and at the time when printing ends. FIG. 9 is a flowchart of image formation by the monochrome image forming apparatus of the embodiment when the concentration of toner particles contained in the liquid developer within the photoconductor buffer tank 51 is a signal used for switching of the three-way valve 58*a*.

First, the concentration of toner particles contained in the liquid developer within the photoconductor buffer tank 51 is measured by a transmissive photosensor that senses the toner particle concentration, a torque sensing unit that senses stirring torque of stirring blades provided within the photoconductor buffer tank 51, and a unit that senses the toner particle concentration such as a reflective photosensor that senses the liquid level of the liquid developer within the photoconductor buffer tank 51.

When the toner particle concentration is equal to or less than a predetermined concentration, the three-way valve 58*a* is switched so that the liquid feed path from the photoconductor buffer tank 51 to the filtration filter 56 may be opened and the liquid feed path from the photoconductor buffer tank 51 to the waste liquid tank 48 may be closed, and the liquid developer stored in the photoconductor buffer tank 51 is fed to the filtration filter 56 by the pump 52. Then, the liquid developer concentrated by the filtration filter 56 is fed to the photoconductor buffer tank 51. The liquid carrier separated from the liquid developer by the filtration filter 56 is fed to the liquid carrier tank 57 via a liquid carrier transport part 59A that transports the liquid carrier from the filtration filter 56 to the liquid carrier storage part and stored.

When the toner particle concentration in the liquid developer within the photoconductor buffer tank 51 is more than the predetermined concentration, the three-way valve 58*a* is switched so that the liquid feed path from the photoconductor buffer tank 51 to the filtration filter 56 may be closed and the liquid feed path from the photoconductor buffer tank 51 to the waste liquid tank 48 may be opened, and the liquid developer stored in the photoconductor buffer tank 51 is fed to the waste liquid tank 48 by the pump 52 and stored. Thereby, the liquid developer at the high toner particle concentration does not flow into the filtration filter 56 and the filtration filter 56 is not clogged for a long period.

Furthermore, the three-way valve 60*a* is switched so that the liquid feed path from the liquid carrier tank 57 to the stirring tank 53 may be closed and the liquid feed path from the liquid carrier tank 57 to the filtration filter 56 may be opened, and the liquid carrier stored in the liquid carrier tank 57 is fed to the filtration filter 56 sequentially via the liquid carrier transport part 59B and the three-way valve 60*a* by the pump 558 (reverse flow sequence). Thereby, the liquid carrier that has passed through the filtration filter 56 is discarded into the waste liquid tank 48 through the photoconductor buffer tank 51 together with the solid components of the toner particles accumulated on the separation film of the filtration filter 56 and the like. Cleaning of the filtration filter by the reverse flow sequence extends the life of the filtration filter.

A controller (CPU) for management of image signals predicts the toner particle concentration in the liquid developer within the liquid developer container 31 and the toner particle concentration in the liquid developer within the photoconductor buffer tank 51 according to the coverage of output images, and can make predictive control of the replenishment from the supplementary liquid developer tank 54 and the liquid carrier tank 57 and the concentration of the liquid developer by the filtration filter 56. The predictive control improves the control response and reliability.

In the primary transfer section, the photoconductor 10 and the intermediate transfer member 40 moves at an equal speed and the developer image developed on the photoconductor 10 is transferred to the intermediate transfer member 40 by the primary transfer roller, and thereby, the drive load of the rotation and movement of the intermediate transfer member 40 is reduced and the disturbance action on the apparent image on the photoconductor 10 is suppressed.

For execution of a preferred secondary transfer function and fixing function in the stage that the toner image on the intermediate transfer member 40 is secondarily transferred to the recording medium and the fixing step stage (omitted to be shown), a desirable toner particle concentration is about 40% to 60% by mass. When the toner particles do not reach a desirable dispersion condition at the fixing step stage, the intermediate transfer member squeeze device (not shown) is provided as means that further removes the excessive carrier from the intermediate transfer member 40. The intermediate transfer member squeeze device also has a function of raising the toner particle ratio within the apparent image and collecting fogging toner, which is unwanted in the first place. When the squeezing performance by the photoconductor 10 in the primary transfer position at the upstream side of the above described intermediate transfer member squeezing step is sufficient, it is unnecessary to provide the intermediate transfer member squeeze device at the downstream of the primary transfer step in the moving direction of the intermediate transfer member 40.

The recording medium is supplied concurrently with the timing when the toner image on the intermediate transfer member 40 reaches the secondary transfer position and the toner image is secondarily transferred to the recording medium, and then, the final image formation on the recording medium is finished at the fixing step. When a recording medium supply trouble such as jamming occurs, not all of toner images are transferred to the secondary transfer roller and not collected, and part of toner images are left on the intermediate transfer member 40. In the normal secondary transfer step, not 100% of the toner images on the intermediate transfer member 40 are secondarily transferred to the recording medium, but several percents of residual secondary transfer are caused. Especially, when the recording medium supply trouble such as jamming occurs, the toner images on the intermediate transfer member 40 are brought into contact with the secondary transfer roller 61 and secondarily transferred with no recording medium in between, and smudges on the back of the recording medium are caused. To the unwanted toner images on the intermediate transfer member 40, a bias that presses the toner particles of the liquid developer against the intermediate transfer member 40 side, i.e., a bias having the same polarity as the charging polarity of the toner particles is applied. The bias applied when a trouble such as jamming occurs is applied to one of the secondary transfer roller 61 and the intermediate transfer member squeeze roller. By application of the bias, the toner particles of the liquid developer left on the intermediate transfer member 40 are pressed against the intermediate transfer member 40 side and the liquid carrier is collected to the secondary transfer roller 61 side, and therefore, the cleaning on the intermediate transfer member 40 by the cleaning blade 46 of the intermediate transfer member 40 and the cleaning of the secondary transfer roller 61 by the cleaning blade (not shown) of the secondary transfer roller are efficiently performed.

Figure 10:
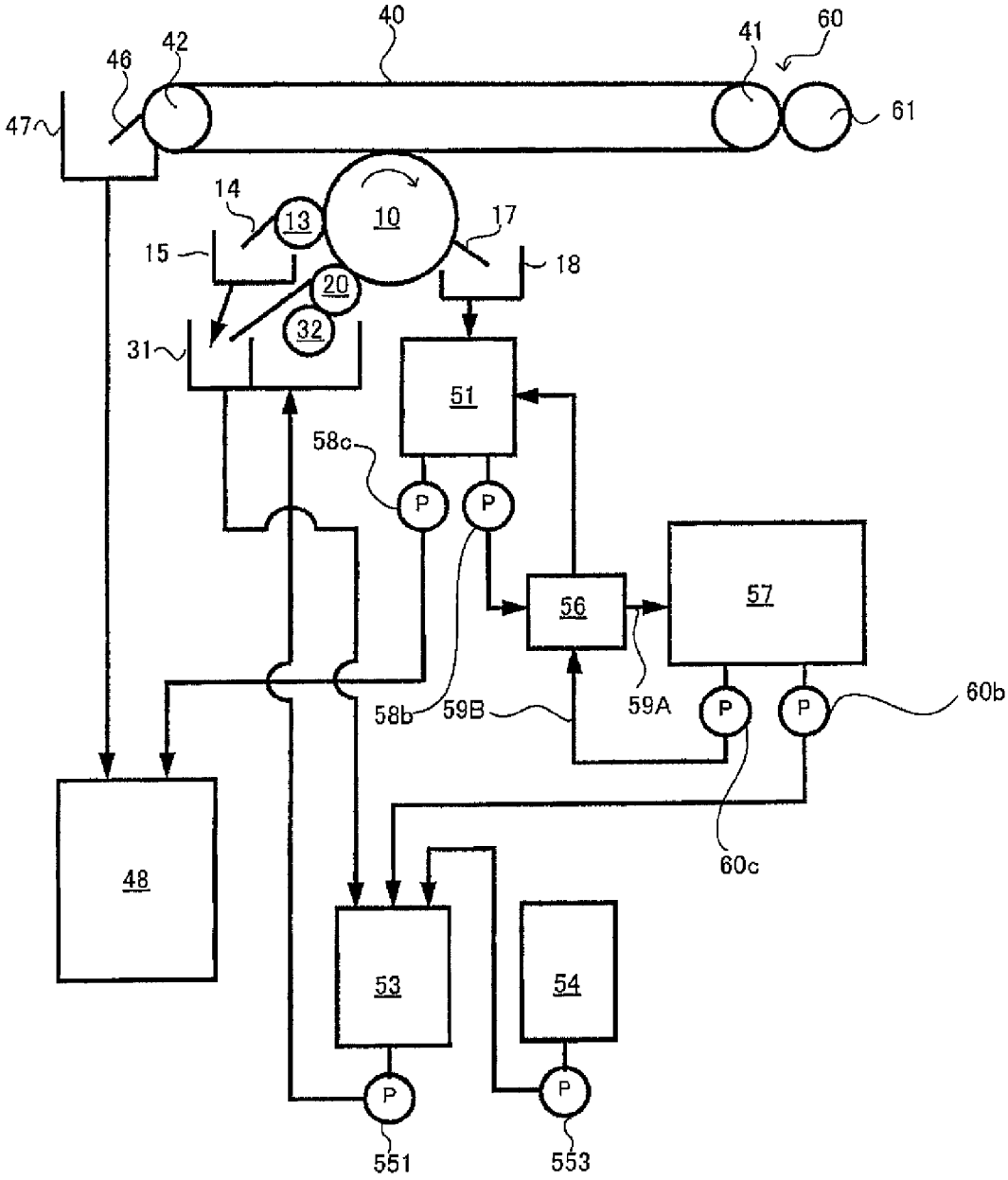
FIG. 10 is a schematic diagram showing an embodiment of a monochrome image forming apparatus.

FIG. 10 is a schematic diagram showing an image forming apparatus of another embodiment of the invention. The monochrome image forming apparatus of the embodiment shown in FIG. 10 has a first pair of pumps (58*b*, 58*c*) and a second pair of pumps (60*b*, 60*c*) in place of the three-way valves 58*a*, 60*a* of the monochrome image forming apparatus of the embodiment shown in FIG. 8. Dispensation of a liquid developer is switched by turning ON/OFF of the first pair of pumps (58*b*, 58*c*) as a channel switching part that dispenses the liquid developer collected by a cleaning part for collecting the liquid developer on an image carrier, and dispensation of a liquid carrier is switched by turning ON/OFF of the second pair of pumps (60*b*, 60*c*). Specific examples of signals used for turning ON/OFF of the first pair of pumps (58*b*, 58*c*) and the second pair of pumps (60*b*, 60*c*) are signals of the concentration of toner particles contained in the liquid developer within a photo conductor buffer tank 51 (developer concentration), the pressure of the liquid developer fed from the first pair of pumps (58*b*, 58*c*) to a filtration filter 56, the number of printed recording media, and at the time when printing ends. As below, an example in which the concentration of toner particles contained in the liquid developer within the photoconductor buffer tank 51 is used as the signal will be explained.

First, the concentration of toner particles contained in the liquid developer within the photoconductor buffer tank 51 is measured by a transmissive photosensor that senses the toner particle concentration, torque sensing means that senses stirring torque of stirring blades provided within the photoconductor buffer tank 51, and a unit that senses the toner particle concentration such as a reflective photosensor that senses the liquid level of the liquid developer within the photoconductor buffer tank 51.

When the toner particle concentration is equal to or less than a predetermined concentration, the pump 58*b* that feeds a liquid from the photoconductor buffer tank 51 to the filtration filter 56 is actuated and the pump 58*c* that feeds a liquid from the photoconductor buffer tank 51 to the waste liquid tank 48 is stopped, and the liquid developer stored in the photoconductor buffer tank 51 is fed to the filtration filter 56 by the pump 58*b*. Then, the liquid developer concentrated by the filtration filter 56 is fed to the photoconductor buffer tank 51. The liquid carrier separated from the liquid developer by the filtration filter 56 is fed to a liquid carrier tank 57 as a first storage part via a liquid carrier transport part 59A that transports the liquid carrier from the filtration filter 56 and stored. The filtration filter 56 is a filtering part provided in a first channel for flowing the liquid developer dispensed by the channel switching part for filtering the liquid developer flowing in the first channel. The liquid carrier tank 57 is the first storage part connected to the first channel for storing the liquid developer flowing in the first channel. The waste liquid tank 48 is a second storage part connected to a second channel for flowing the liquid developer dispensed by the channel switching part for storing the liquid developer flowing in the second channel.

When the toner particle concentration in the liquid developer within the photoconductor buffer tank 51 is more than the predetermined concentration, the pump 58*b* that feeds a liquid from the photoconductor buffer tank 51 to the filtration filter 56 is stopped and the pump 58*c* that feeds a liquid from the photoconductor buffer tank 51 to the waste liquid tank 48 is activated, and the liquid developer stored in the photoconductor buffer tank 51 is fed to the waste liquid tank 48 by the pump 58*c* and stored. Thereby, the liquid developer at the high toner particle concentration does not flow into the filtration filter 56 and the filtration filter 56 is not clogged for a long period.

Furthermore, the pump 60*b* that feeds a liquid from the liquid carrier tank 57 to the stirring tank 53 is stopped and the pump 60*c* that feeds a liquid from the liquid carrier tank 57 to the filtration filter 56 is activated, and the liquid carrier stored in the liquid carrier tank 57 is fed to the filtration filter 56 via a liquid carrier transport part 59B by the pump 60*c* (reverse flow sequence). Thereby, the liquid carrier that has passed through the filtration filter 56 is discarded into the waste liquid tank 48 via the photoconductor buffer tank 51 together with the solid components of the toner particles accumulated on the separation film of the filtration filter 56 and the like.

Figure 11:
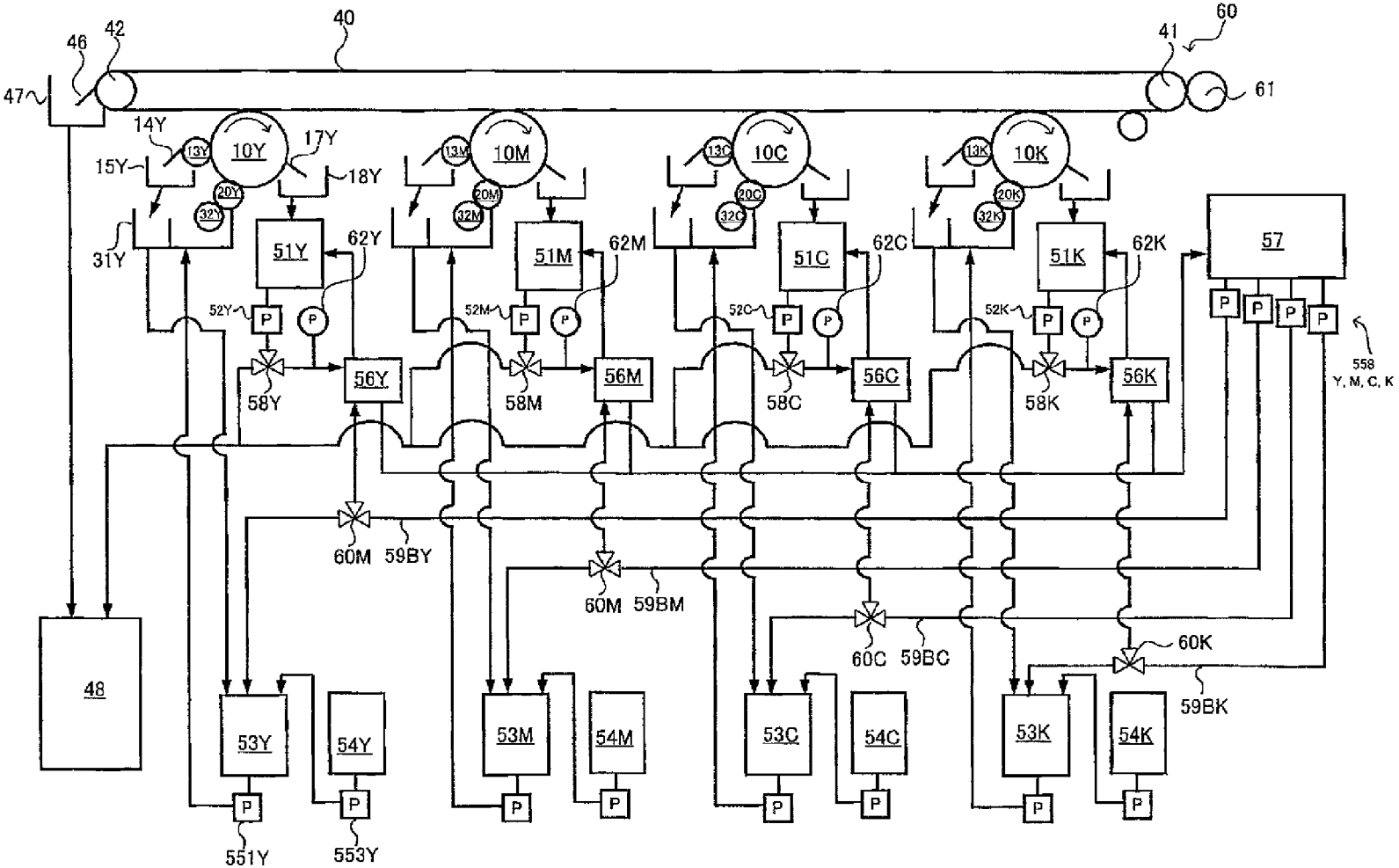
FIG. 11 is a schematic diagram showing an embodiment of a color image forming apparatus.

FIG. 11 is a schematic diagram showing an image forming apparatus of another embodiment of the invention. In FIG. 11, the numerals assigned to the same component elements are the same with respect to the respective colors of yellow (Y), magenta (M), cyan (C), black (K). As below, a liquid developer transport device of yellow (Y) will be explained. The liquid developer transport devices of the respective colors of magenta (M), cyan (C), and black (K) are the same as the liquid developer transport device of yellow (Y).

Specific examples of signals used for switching of a three-way valve 58Y are signals of the concentration of toner particles contained in a liquid developer within a photoconductor buffer tank 51Y, the pressure of the liquid developer fed from the three-way valve 58Y to a filtration filter 56Y, the number of printed recording media, and at the time when printing ends. As below, image formation by the color image forming apparatus of the embodiment when the pressure of the liquid developer fed from the three-way valve 58Y to the filtration filter 56Y is a signal used for switching of the three-way valve 58Y will be explained.

First, the pressure of the liquid developer fed from the three-way valve 58Y to the filtration filter 58Y is measured by a pressure sensor unit 62Y.

When the pressure is equal to or less than predetermined pressure, the three-way valve 58Y is switched so that the liquid feed path from a photoconductor buffer tank 51Y to the filtration filter 56Y may be opened and the liquid feed path from the photoconductor buffer tank 51Y to a waste liquid tank 48 as a second storage part may be closed, and the liquid developer stored in the photoconductor buffer tank 51Y is fed to the filtration filter 56Y by a pump 52Y. Then, the liquid developer concentrated by the filtration filter 56Y is fed to the photoconductor buffer tank 51Y. The liquid carrier separated from the liquid developer by the filtration filter 56Y is fed to a liquid carrier tank 57 as a first storage part via a liquid carrier transport part that transports the liquid carrier from the filtration filter 56Y and stored.

The three-way valve 58Y is a channel switching part that dispenses the liquid developer collected by a cleaning part for collecting the liquid developer on the image carrier. The filtration filter 58Y is a filtering part provided in a first channel for flowing the liquid developer dispensed by the channel switching part for filtering the liquid developer flowing in the first channel. The liquid carrier tank 57 is the first storage part connected to the first channel for storing the liquid developer flowing in the first channel. The waste liquid tank 48 is the second storage part connected to a second channel for flowing the liquid developer dispensed by the channel switching part for storing the liquid developer flowing in the second channel.

When the concentration of the toner particles in the liquid developer becomes higher and the pressure is more than the predetermined pressure, the three-way valve 58Y is switched so that the liquid feed path from the photoconductor buffer tank 51Y to the filtration filter 56Y may be closed and the liquid feed path from the photoconductor buffer tank 51Y to the waste liquid tank 48 may be opened, and the liquid developer stored in the photoconductor buffer tank 51Y is fed to the waste liquid tank 48 by the pump 52Y and stored. Thereby, the liquid developer at the high toner particle concentration does not flow into the filtration filter 56Y and the filtration filter 56Y is not clogged for a long period.

Furthermore, the three-way valve 58Y is switched so that the liquid feed path from the liquid carrier tank 57 to the stirring tank 53Y may be closed and the liquid feed path from the liquid carrier tank 57 to the filtration filter 56Y may be opened, and the liquid carrier stored in the liquid carrier tank 57 is fed to the filtration filter 56Y sequentially via a liquid carrier transport part 59BY and the three-way valve 60Y by a pump 558Y (reverse flow sequence). Thereby, the liquid carrier that has passed through the filtration filter 56Y is discarded into the waste liquid tank 48 via the photoconductor buffer tank 51 together with the solid components of the toner particles accumulated on the separation film of the filtration filter 56Y and the like. Cleaning of the filtration filter by the reverse flow sequence extends the life of the filtration filter.

Figure 12:
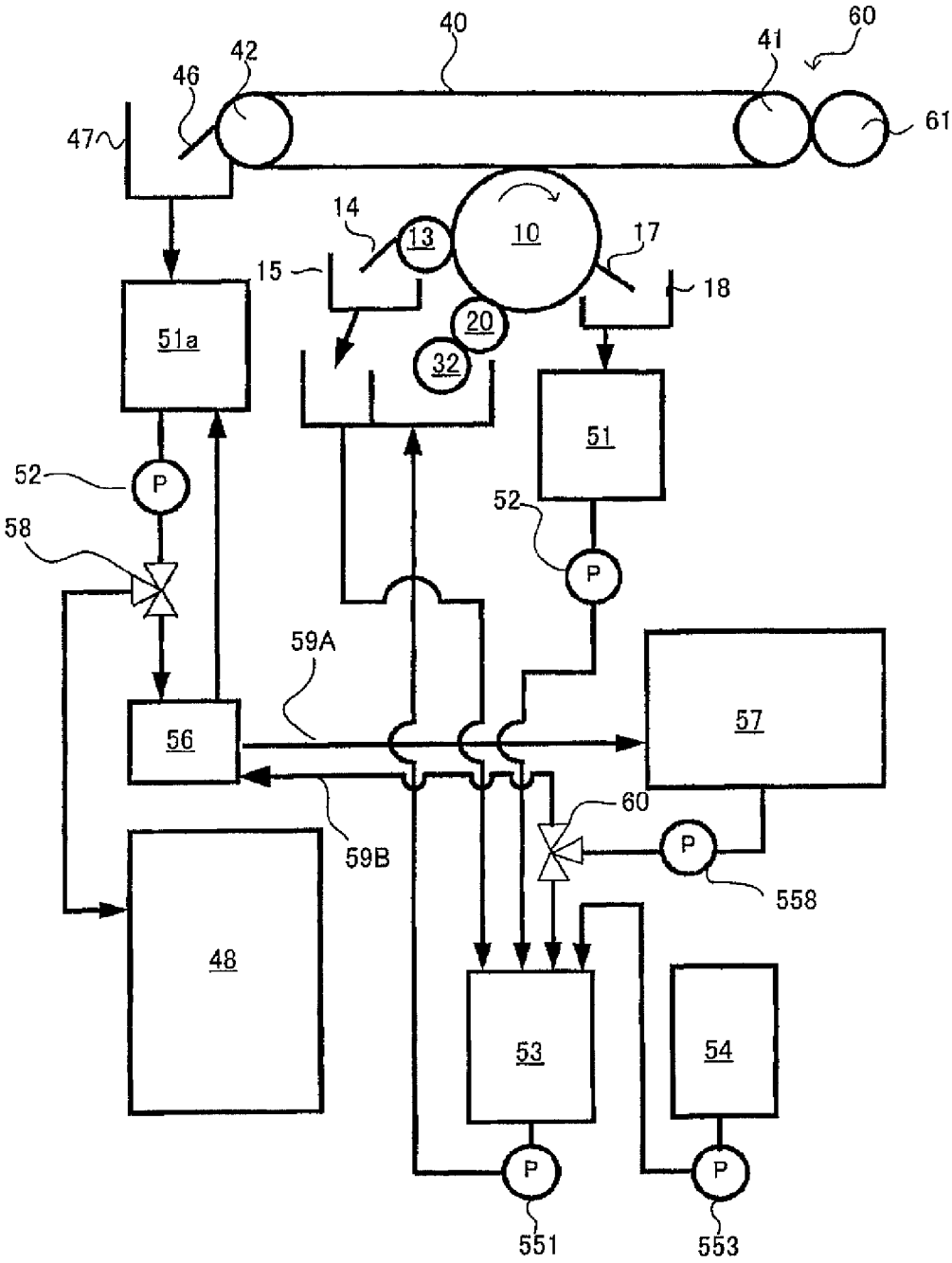
FIG. 12 is a schematic diagram showing an embodiment of a monochrome image forming apparatus.

FIG. 12 is a schematic diagram showing an image forming apparatus of another embodiment of the invention. The monochrome image forming apparatus of the embodiment has a liquid developer transport device for a liquid developer collected by a cleaning device as a cleaning part including a cleaning blade 46 and a liquid developer collecting part 47 for collecting the liquid developer of a transfer member from an intermediate transfer member 40 as the transfer member. The liquid developer collected by the liquid developer collecting part 47 is stored in a belt cleaning buffer tank 51*a*. The liquid developer stored in the belt cleaning buffer tank 51*a* is fed to a filtration filter 56 or a waste liquid tank 48 through a three-way valve 58 that dispenses the liquid developer to the filtration filter 56 or the waste liquid tank 48 by a pump 52. The three-way valve 58 is a channel switching part that dispenses the liquid developer collected by the cleaning part for collecting the liquid developer on the transfer member. The filtration filter 56 is a filtering part provided in a first channel for flowing the liquid developer dispensed by the channel switching part for filtering the liquid developer flowing in the first channel. A liquid carrier tank 57 is a first storage part connected to the first channel for storing the liquid developer flowing in the first channel. The waste liquid tank 48 is a second storage part connected to a second channel for flowing the liquid developer dispensed by the channel switching part for storing the liquid developer flowing in the second channel.

Figure 13:
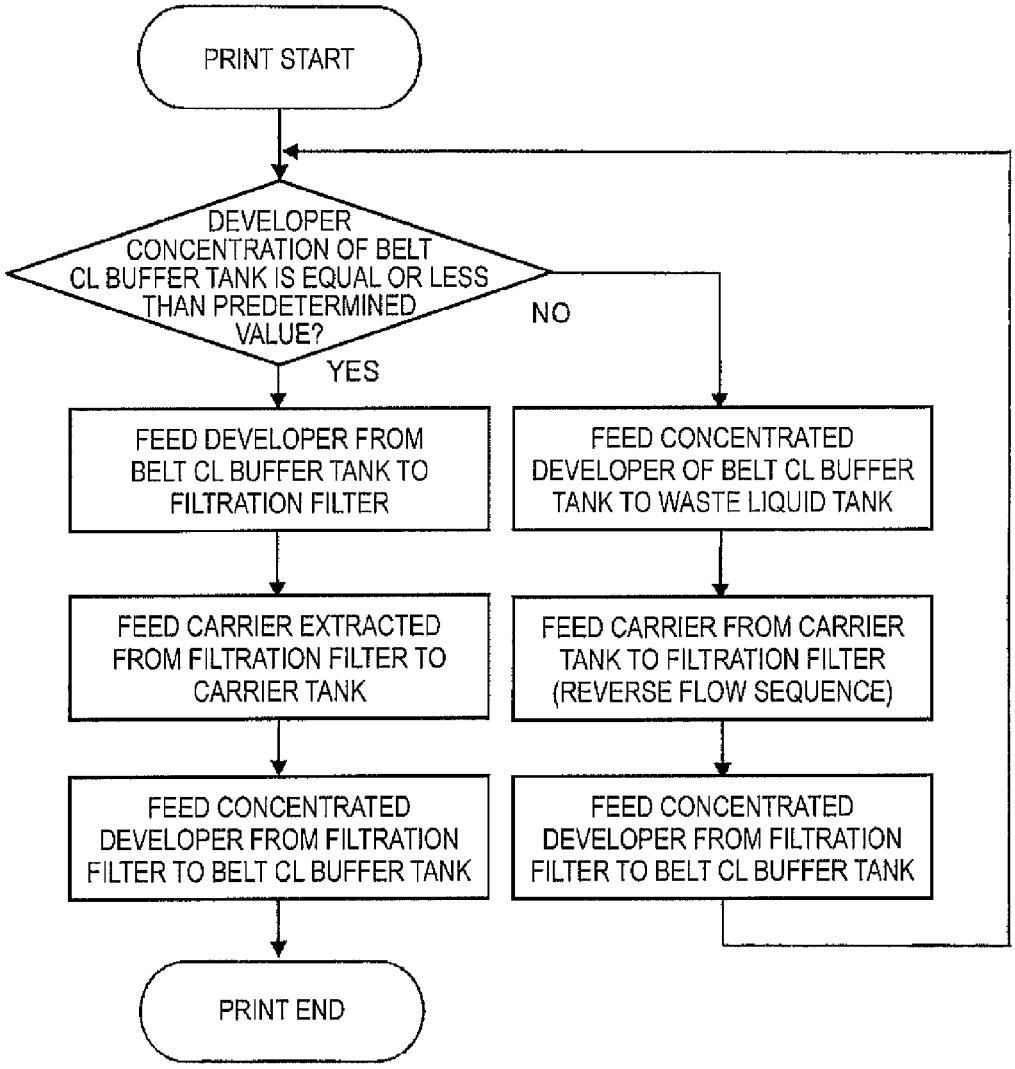
FIG. 13 is a flowchart of image formation by the monochrome image forming apparatus.

Specific examples of signals used for switching of the three-way valve 58 are signals of the concentration of toner particles contained in the liquid developer within the belt cleaning buffer tank (belt CL buffer tank) 51*a* (developer concentration), the pressure of the liquid developer fed from the three-way valve 58 to the filtration filter 56, the number of printed recording media, and at the time when printing ends. FIG. 13 is a flowchart of image formation by the image forming apparatus of the embodiment when the concentration of toner particles contained in the liquid developer within the belt cleaning buffer tank 51*a* is a signal used for switching of the three-way valve 58.

First, the concentration of toner particles contained in the liquid developer within the belt cleaning buffer tank 51*a* is measured by a transmissive photosensor that senses the toner particle concentration, a torque sensing unit that senses stirring torque of stirring blades provided within the belt cleaning buffer tank 51*a*, and a unit that senses the toner particle concentration such as a reflective photosensor that senses the liquid level of the liquid developer within the belt cleaning buffer tank 51*a*.

When the toner particle concentration is equal to or less than a predetermined concentration, the three-way valve 58 is switched so that the liquid feed path from the belt cleaning buffer tank 51*a* to the filtration filter 56 may be opened and the liquid feed path from the belt cleaning buffer tank 51*a* to the waste liquid tank 48 may be closed, and the liquid developer stored in the belt cleaning buffer tank 51*a* is fed to the filtration filter 56 by the pump 52. Then, the liquid developer concentrated by the filtration filter 56 is fed to the belt cleaning buffer tank 51*a*. The liquid carrier separated from the liquid developer by the filtration filter 56 is fed to the liquid carrier tank 57 via a liquid carrier transport part 59A that transports the liquid carrier from the filtration filter 56 to the liquid carrier storage part and stored.

When the toner particle concentration in the liquid developer within the belt cleaning buffer tank 51*a* is more than the predetermined concentration, the three-way valve 58 is switched so that the liquid feed path from the belt cleaning buffer tank 51*a* to the filtration filter 56 may be closed and the liquid feed path from the belt cleaning buffer tank 51*a* to the waste liquid tank 48 may be opened, and the liquid developer stored in the belt cleaning buffer tank 51*a* is fed to the waste liquid tank 48 by the pump 52 and stored. Thereby, the liquid developer at the high toner particle concentration does not flow into the filtration filter 56 and the filtration filter 56 is not clogged for a long period.

Furthermore, the three-way valve 60 is switched so that the liquid feed path from the liquid carrier tank 57 to a stirring tank 53 may be closed and the liquid feed path from the liquid carrier tank 57 to the filtration filter 56 may be opened, and the liquid carrier stored in the liquid carrier tank 57 is fed to the filtration filter 56 sequentially via a liquid carrier transport part 59B and the three-way valve 60 by a pump 558 (reverse flow sequence). Thereby, the liquid carrier that has passed through the filtration filter 56 is discarded into the waste liquid tank 48 via the belt cleaning buffer tank 51*a* together with the solid components of the toner particles accumulated on the separation film of the filtration filter 56 and the like. Cleaning of the filtration filter by the reverse flow sequence extends the life of the filtration filter.

Figure 14:
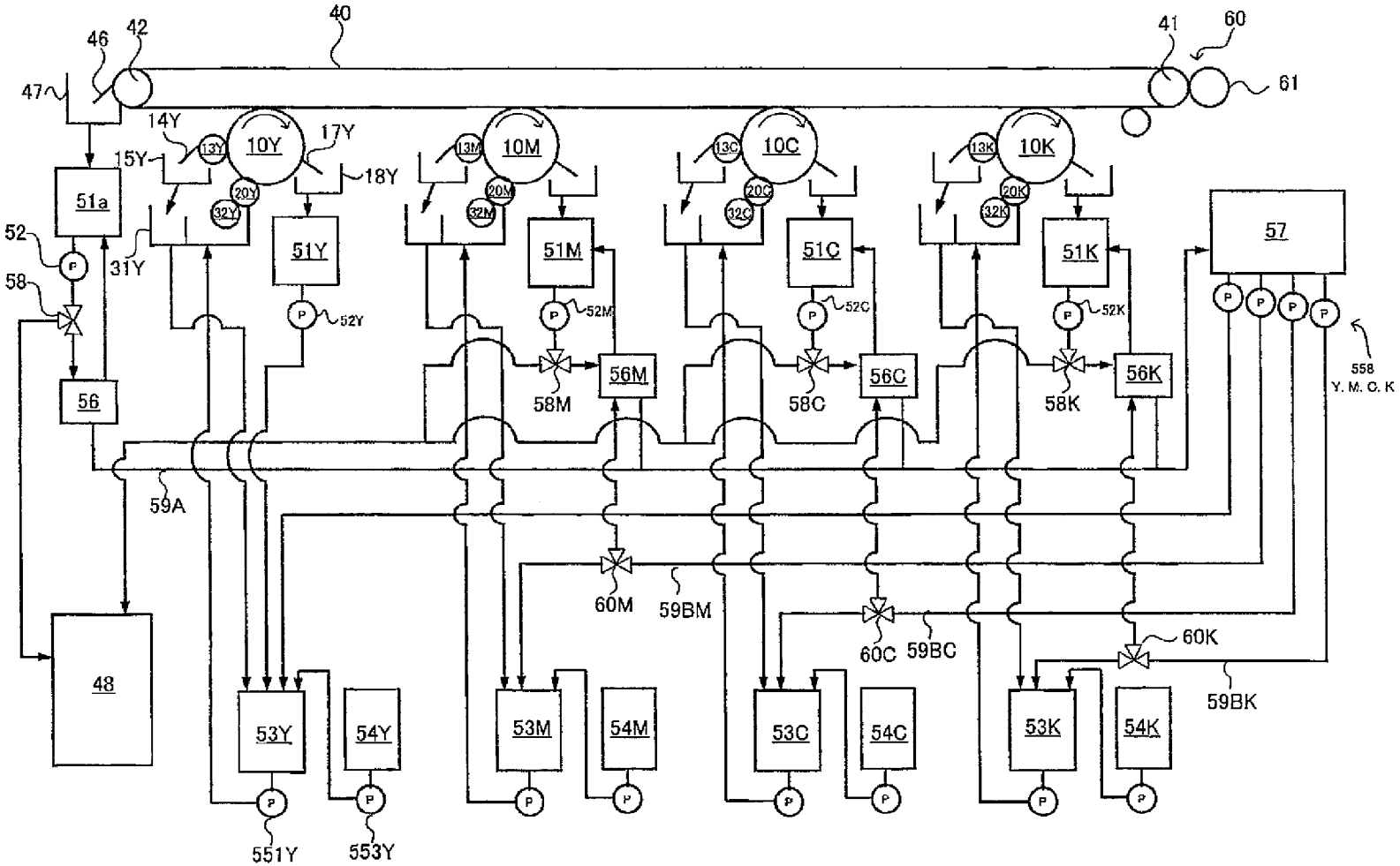
FIG. 14 is a schematic diagram showing an embodiment of a color image forming apparatus.

FIG. 14 is a schematic diagram showing an image forming apparatus of another embodiment of the invention. The color image forming apparatus of the embodiment has no liquid developer transport device for the first color, but has a liquid developer transport device for a liquid developer collected by a cleaning device as a cleaning part including a cleaning blade 46 and a liquid developer collecting part 47 for collecting the liquid developer of a transfer member from an intermediate transfer member 40 as the transfer member. The liquid developer collected by the liquid developer collecting part 47 is stored in a belt cleaning buffer tank 51*a*. The liquid developer stored in the belt cleaning buffer tank 51*a* is fed to a filtration filter 56 or a waste liquid tank 48 through a three-way valve 58 that dispenses the liquid developer to the filtration filter 56 or the waste liquid tank 48 by a pump 52. The three-way valve 58 is a channel switching part that dispenses the liquid developer collected by the cleaning part for collecting the liquid developer on the transfer member. The filtration filter 56 is a filtering part provided in a first channel for flowing the liquid developer dispensed by the channel switching part for filtering the liquid developer flowing in the first channel. A liquid carrier tank 57 is a first storage part connected to the first channel for storing the liquid developer flowing in the first channel. The waste liquid tank 48 is a second storage part connected to a second channel for flowing the liquid developer dispensed by the channel switching part for storing the liquid developer flowing in the second channel.

Specific examples of signals used for switching of the three-way valve 58 are signals of the concentration of toner particles contained in the liquid developer within the belt cleaning buffer tank (belt CL buffer tank) 51*a* (developer concentration), the pressure of the liquid developer fed from the three-way valve 58 to the filtration filter 56, the number of printed recording media, and at the time when printing ends. As below, image formation by the color image forming apparatus of the embodiment when the concentration of toner particles contained in the liquid developer within the belt cleaning buffer tank 51*a* is a signal used for switching of the three-way valve 58 will be explained.

First, the concentration of toner particles contained in the liquid developer within the belt cleaning buffer tank 51*a* is measured by a transmissive photosensor that senses the toner particle concentration, a torque sensing unit that senses stirring torque of stirring blades provided within the belt cleaning buffer tank 51*a*, and a unit that senses the toner particle concentration such as a reflective photosensor that senses the liquid level of the liquid developer within the belt cleaning buffer tank 51*a*.

When the toner particle concentration is equal to or less than a predetermined concentration, the three-way valve 58 is switched so that the liquid feed path from the belt cleaning buffer tank 51*a* to the filtration filter 56 may be opened and the liquid feed path from the belt cleaning buffer tank 51*a* to the waste liquid tank 48 may be closed, and the liquid developer stored in the belt cleaning buffer tank 51*a* is fed to the filtration filter 56 by the pump 52. Then, the liquid developer concentrated by the filtration filter 56 is fed to the belt cleaning buffer tank 51*a*. The liquid carrier separated from the liquid developer by the filtration filter 56 is fed to the liquid carrier tank 57 as a first storage part via a liquid carrier transport part 59A that transports the liquid carrier from the filtration filter 56 to the liquid carrier storage part and stored.

When the toner particle concentration in the liquid developer within the belt cleaning buffer tank 51*a* is more than the predetermined concentration, the three-way valve 58 is switched so that the liquid feed path from the belt cleaning buffer tank 51*a* to the filtration filter 56 may be closed and the liquid feed path from the belt cleaning buffer tank 51*a* to the waste liquid tank 48 may be opened, and the liquid developer stored in the belt cleaning buffer tank 51*a* is fed to the waste liquid tank 48 by the pump 52 and stored. Thereby, the liquid developer at the high toner particle concentration does not flow into the filtration filter 56 and the filtration filter 56 is not clogged for a long period.

In FIG. 14, the numerals assigned to the same component elements are the same with respect to the respective colors of yellow (Y), magenta (M), cyan (C), black (K). A color image forming apparatus of the embodiment has liquid developer transport devices of the respective colors of magenta (M), cyan (C) and black (K). As below, a liquid developer transport device of magenta (M) will be explained. The liquid developer transport devices of the respective colors of cyan (C) and black (K) are the same as the liquid developer transport device of magenta (M).

Specific examples of signals used for switching of a three-way valve 58M as a channel switching part that disperses the liquid developer collected by a cleaning part for collecting the liquid developer on the image carrier are signals of the concentration of toner particles contained in a liquid developer within a photoconductor buffer tank 51M, the pressure of the liquid developer fed from the three-way valve 58M to a filtration filter 56M, the number of printed recording media, and at the time when printing ends. As below, image formation by the color image forming apparatus of the embodiment when the toner particle concentration contained in the liquid developer within the photoconductor buffer tank 51M is a signal used for switching of the three-way valve 58M will be explained.

First, the toner particle concentration contained in the liquid developer within the photoconductor buffer tank 51M is measured by a transmissive photosensor that senses the toner particle concentration, a torque sensing unit that senses stirring torque of stirring blades provided within the photoconductor buffer tank 51M, and a unit that senses the toner particle concentration such as a reflective photosensor that senses the liquid level of the liquid developer within the photoconductor buffer tank 51M.

When the toner particle concentration is equal to or less than a predetermined concentration, the three-way valve 58M is switched so that the liquid feed path from the photoconductor buffer tank 51M to the filtration filter 56M may be opened and the liquid feed path from the photoconductor buffer tank 51M to a waste liquid tank 48 as a second storage part may be closed, and the liquid developer stored in the photoconductor buffer tank 51M is fed to the filtration filter 56M by a pump 52M. Then, the liquid developer concentrated by the filtration filter 56M is fed to the photoconductor buffer tank 51M. The liquid carrier separated from the liquid developer by the filtration filter 56M is fed to a liquid carrier tank 57 as a first storage part via a liquid carrier transport part 59A that transports the liquid carrier from the filtration filter 56M and stored. The filtration filter 56M is a filtering part provided in a first channel for flowing the liquid developer dispensed by the channel switching part for dispensing the liquid developer collected by the cleaning part for collecting the liquid developer on the image carrier for filtering the liquid developer flowing in the first channel. The liquid carrier tank 57 is also the first storage part connected to the first channel for storing the liquid developer flowing in the first channel. The waste liquid tank 48 is also the second storage part connected to a second channel for flowing the liquid developer dispensed by the channel switching part for storing the liquid developer flowing in the second channel.

When the toner particle concentration contained in the liquid developer within the photoconductor buffer tank 51M is more than the predetermined concentration, the three-way valve 58M is switched so that the liquid feed path from the photoconductor buffer tank 51M to the filtration filter 56M may be closed and the liquid feed path from the photoconductor buffer tank 51M to the waste liquid tank 48 may be opened, and the liquid developer stored in the photoconductor buffer tank 51M is fed to the waste liquid tank 48 by the pump 52M and stored. Thereby, the liquid developer at the high toner particle concentration does not flow into the filtration filter 56M and the filtration filter 56M is not clogged for a long period.

Furthermore, the three-way valve 60M is switched so that the liquid feed path from the liquid carrier tank 57 to the stirring tank 53M may be closed and the liquid feed path from the liquid carrier tank 57 to the filtration filter 56M may be opened, and the liquid carrier stored in the liquid carrier tank 57 is fed to the filtration filter 56M sequentially via a liquid carrier transport part 59BM and the three-way valve 60M by a pump 558M (reverse flow sequence). Thereby, the liquid carrier that has passed through the filtration filter 56M is discarded into the waste liquid tank 48 via the photoconductor buffer tank 51M together with the solid components of the toner particles accumulated on the separation film of the filtration filter 56M and the like. Cleaning of the filtration filter 56M by the reverse flow sequence extends the life of the filtration filter 56M.

The image forming apparatus of the invention is not limited to the above embodiments but various changes can be made. For example, the image forming apparatus of another embodiment of the invention may be a tandem-type color image forming apparatus having a liquid carrier collection system for a cleaning device of any one to three of the respective colors and/or an intermediate transfer member. The image forming apparatus of another embodiment of the invention may be a rotary-type color image forming apparatus in which plural image forming parts corresponding to the respective development colors are supported by a cylindrical rotary supporter, the respective image forming parts are sequentially moved to the transfer position of an intermediate transfer member by the rotation of the rotational supporter, and toner images of the respective colors are sequentially transferred with one image superimposed on another. Further, an intermediate transfer drum may be used in the image forming apparatus of the embodiment of the invention. When an intermediate transfer drum is used in the image forming apparatus of the embodiment of the invention, an intermediate transfer member cleaning blade provided on the intermediate transfer member is set apart from the intermediate transfer member during a primary transfer process in which a toner image is transferred from an image forming part to the intermediate transfer member and during passing of a full-color toner image or monochrome toner image from the intermediate transfer member to the recording medium, and then, after a so-called printing operation is ended, brought into contact with the intermediate transfer member at its edge and pressed and slid thereon.

The entire disclosure of Japanese Patent Application Nos: 2007-285950, filed Nov. 2, 2007 and 2008-127067, filed May 14, 2008 are expressly incorporated by reference herein.

What is claimed is:

1. A liquid developer transport device comprising:
a channel switching part that dispenses a liquid developer;
a first channel for flowing the liquid developer dispensed by the channel switching part;
a filtering part provided in the first channel for filtering the liquid developer flowing in the first channel;
a first storage part connected to the first channel for storing the liquid developer filtered by the filtering part;
a second channel for flowing the liquid developer dispensed by the channel switching part; and
a second storage part connected to the second channel for storing the liquid developer flowing in the second channel,
wherein the channel switching part switches channels when a toner particle concentration is more than a predetermined concentration.

2. The liquid developer transport device according to claim 1, wherein the filtering part is a cross-flow filter.

3. The liquid developer transport device according to claim 1, further comprising a liquid carrier transport part that transports the liquid developer filtered by the filtering part from the first storage part to the filtering part.

4. The liquid developer transport device according to claim 1, wherein the channel switching part is a three-way valve.

5. The liquid developer transport device according to claim 1, wherein the channel switching part includes two pumps.

6. An image forming apparatus comprising:
an image carrier that carries an image;
a cleaning part that collects a liquid developer on the image carrier;
a channel switching part that dispenses the liquid developer collected by the cleaning part;
a first channel for flowing the liquid developer dispensed by the channel switching part;
a filtering part provided in the first channel for filtering the liquid developer flowing in the first channel;
a first storage part connected to the first channel for storing the liquid developer filtered by the filtering part;
a second channel for flowing the liquid developer dispensed by the channel switching part; and
a second storage part connected to the second channel for storing the liquid developer flowing in the second channel,
wherein the channel switching part switches channels when a toner particle concentration is more than a predetermined concentration.

7. The image forming apparatus according to claim 6, wherein the filtering part is a cross-flow filter.

8. The image forming apparatus according to claim 6, further comprising a liquid carrier transport part that transports the liquid developer filtered by the filtering part from the first storage part to the filtering part.

9. The image forming apparatus according to claim 6, wherein the channel switching part is a three-way valve.

10. The image forming apparatus according to claim 6, wherein the channel switching part includes two pumps.

11. An image forming apparatus comprising:
an image carrier that carries an image;
a transfer member on which the image on the image carrier is transferred;
a cleaning part that collects a liquid developer on the transfer member;
a channel switching part that dispenses the liquid developer collected by the cleaning part;
a first channel for flowing the liquid developer dispensed by the channel switching part;
a filtering part provided in the first channel for filtering the liquid developer flowing in the first channel;
a first storage part connected to the first channel for storing the liquid developer filtered by the filtering part;
a second channel for flowing the liquid developer dispensed by the channel switching part; and
a second storage part connected to the second channel for storing the liquid developer flowing in the second channel,
wherein the channel switching part switches channels when a toner particle concentration is more than a predetermined concentration.

12. The image forming apparatus according to claim 11, wherein the filtering part is a cross-flow filter.

13. The image forming apparatus according to claim 11, further comprising a liquid carrier transport part that transports the liquid developer filtered by the filtering part from the first storage part to the filtering part.

14. The image forming apparatus according to claim 11, wherein the channel switching part is a three-way valve.

15. The image forming apparatus according to claim 11, wherein the channel switching part includes two pumps.

* * * * *